United States Patent [19]

Coldren

[11] 4,448,468

[45] May 15, 1984

[54] RECEPTACLE TERMINAL HAVING LATCHING FEATURE

[75] Inventor: Daniel R. Coldren, Enola, Pa.

[73] Assignee: AMP Incorporated, Harrisburg, Pa.

[21] Appl. No.: 396,973

[22] Filed: Jul. 9, 1982

[51] Int. Cl.[3] ..... H01R 13/635

[52] U.S. Cl. ..... 339/74 R; 339/258 S

[58] Field of Search ..... 339/74 R, 258 S, 59 R, 339/59 M, 217 S

[56] References Cited

U.S. PATENT DOCUMENTS

| | | | |
|---|---|---|---|
| 2,738,485 | 3/1956 | Batcheller | 339/258 S |
| 3,409,867 | 11/1968 | Lessner | 339/258 S |
| 3,622,956 | 11/1971 | Zak | 339/258 S |

FOREIGN PATENT DOCUMENTS

| | | | |
|---|---|---|---|
| 5370 | 11/1979 | European Pat. Off. | 339/59 R |
| 43655 | 1/1982 | European Pat. Off. | 339/74 R |
| 1567727 | 5/1969 | France | 339/258 S |
| 858115 | 1/1961 | United Kingdom | 339/258 S |
| 2094563 | 9/1982 | United Kingdom | 339/74 R |

*Primary Examiner*—John McQuade

*Attorney, Agent, or Firm*—Frederick Wraring; R. W. J. Usher

[57] ABSTRACT

Receptacle terminal comprises a web having sidewalls extending from the marginal side portions of the web. The sidewalls extend inwardly towards each other so that a tab can be received between the web and the free edges of the sidewalls. A latching tongue is struck from the web. The tongue has an intermediate portion which extends obliquely from the web towards the free edges of the sidewalls and an engaging portion on its end. The engaging portion extends obliquely away from the free edges of the sidewalls and through the opening produced by forming the tongue. The tongue has a boss thereon which enters an opening in a tab inserted into the receptacle. The tongue can be flexed upon engagement of the engaging portion to disengage the boss from the opening in the tab.

7 Claims, 8 Drawing Figures

FIG. 2
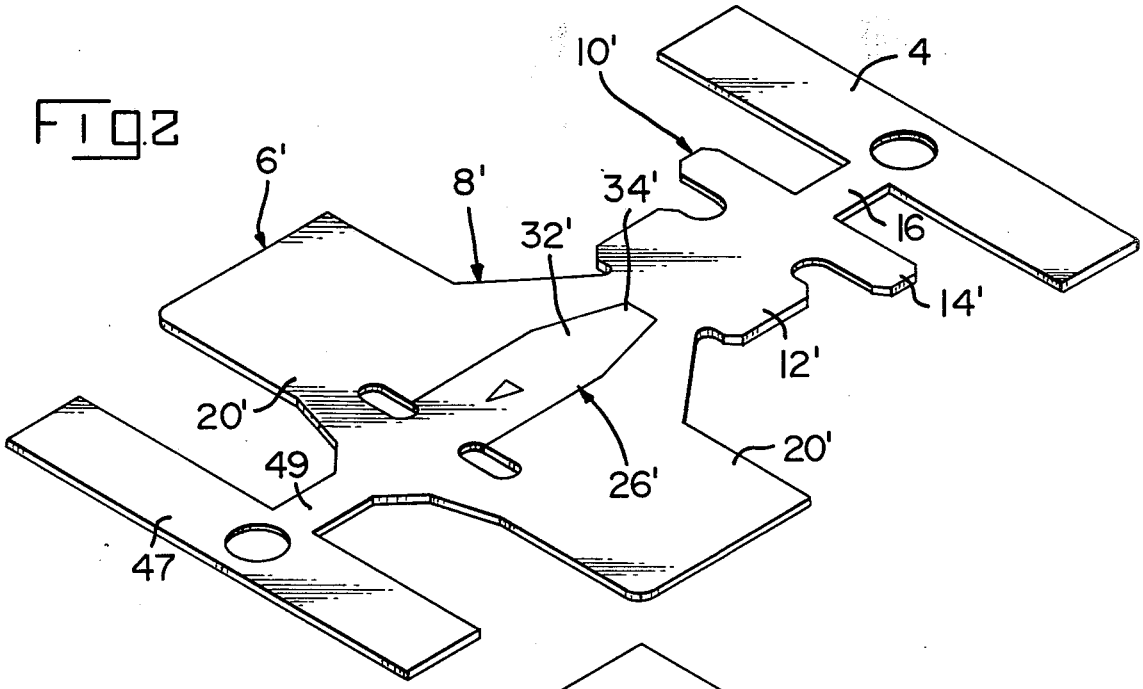
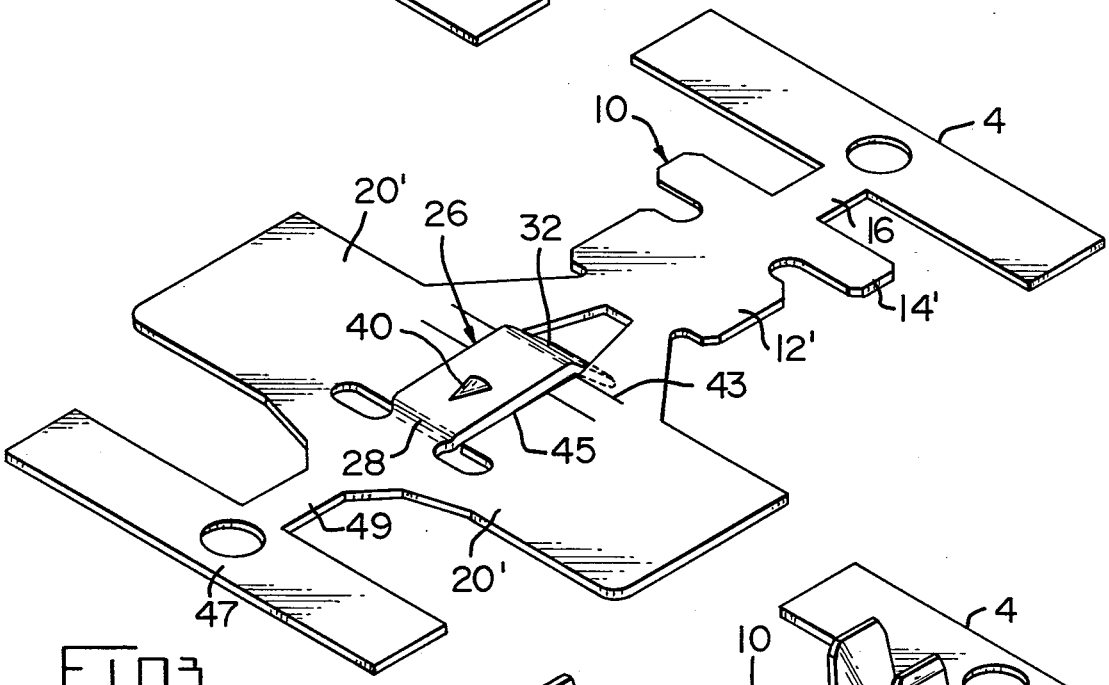
FIG. 3
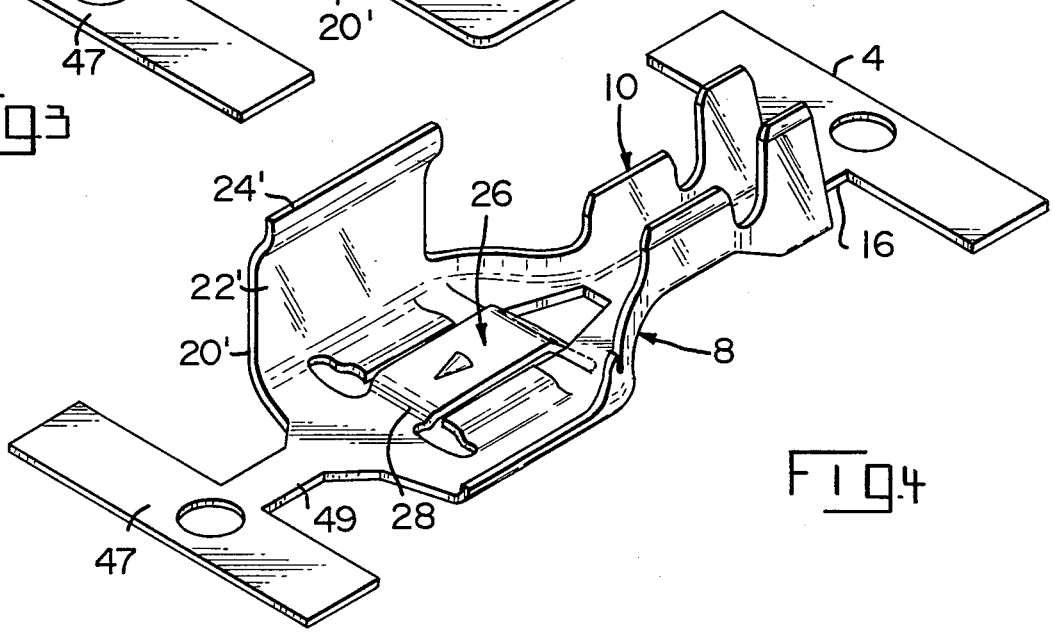
FIG. 4

RECEPTACLE TERMINAL HAVING LATCHING FEATURE

FIELD OF THE INVENTION

This invention relates to stamped and formed terminal receptacles of the type having a web and having sidewalls extending from the marginal side portions of the web. The sidewalls extend inwardly towards each other so that a tab can be inserted between the surface of the web and the free edge portions of the sidewalls. The invention partly relates to terminals having disengageable latching means for latching an inserted terminal tab to the terminal receptacle.

BACKGROUND OF THE INVENTION

U.S. Pat. No. 3,976,348 (U.S. Reissue Pat. No. 30277) discloses a stamped and formed electrical terminal receptacle which is dimensioned to receive a terminal tab having a rectangular cross section. The receptacle terminal is of the type having a web and having sidewalls which extend from the marginal side portions of the web and which are formed inwardly towards each other and towards the web so that a terminal tab can be inserted between the surface of the web and the free edge portions of the sidewalls. Terminals of this general type are widely used for the reason that they can be mated with standard terminal tabs having a rectangular cross section. The terminal receptable described in U.S. Pat. No. 3,976,348 has a tongue extending from the web at the tab receiving end of the receptacle. The tongue is reversely bent at the tab receiving end and has an intermediate portion which engages an inserted tab. The free end of the tongue extends beyond the receptacle section or portion of the terminal and is engageable so that it can be flexed towards the web. The intermediate portion of the tongue has a locking lance which is received in an opening in the tab which locks the tab to the terminal receptacle upon insertion. The tab can be disengaged by simply flexing the tongue towards the web portion of the terminal.

Terminal receptacles having locking feature in U.S. Pat. No. 3,976,348 are being used to an increasing extent on a variety of types of electrical equipment. The provision shows locking feature, which prevents disengagement of the receptacle from an inserted tab, is highly desirable for reasons of improved reliability and safety. Terminal receptacles which are used under circumstances where unauthorized tampering may be a problem can be provided with the locking feature of the above identified U.S. Patent to eliminate problems with unauthorized or mischievous meddling.

The present invention is directed to an improved terminal receptacle having a locking feature which can be produced with substantially less material than the terminal shown in U.S. Pat. No. 3,976,348 and which can be designed to provide a contact force within a broad range at the electrical interface between the terminal receptacle and a tab with which is it mated.

A preferred embodiment of the invention comprises a stamped and formed receptacle terminal having a receptacle portion which is dimensioned to receive a tab-type terminal, the receptacle portion having a web and having sidewalls extending from the marginal side portions of the web. The sidewalls are formed inwardly of the web and towards each other and have free edges which are spaced from the surface of the web. The receptacle portion has a tab-receiving end and an inner end, whereby upon relative movement of the tab into the tab-receiving end towards the inner end, electrical contact is established between the tab and the receptacle portion. The receptacle portion has a releasable latch for releasably latching the tab to the receptacle portion. A receptacle terminal in accordance with the invention is partially characterized in that the releasable latch comprises a latching tongue struck from the web of the receptacle portion, the web having an opening therein which is also produced when the tongue was struck from the web. The tongue has a fixed end and a free end and has side edges extending between the ends and alongside the marginal side portions of the web. The fixed end is proximate to one of the ends of the receptacle portion and the free end is proximate to the other end of the receptacle portion. The tongue has an intermediate portion which extends from the fixed end to a location proximate to the free end and has an engaging ear extending from the intermediate portion to the free end. The engaging ear extends obliquely away from the free edges of the sidewalls and through the opening in the web whereby the free end of the tongue can be engaged and manipulated. Latching portions or latching means are provided on the intermediate portion of the tongue and are engageable with complimentary latching portions on a terminal tab when the tab is inserted into the receptacle portion. The tongue can be disengaged from the tab by engaging the engaging portion of the tongue and flexing the tongue away from the free edges of the sidewalls until the latching portions of the tongue are disengaged from the complimentary latching portions of the tab.

In accordance with a further embodiment, the intermediate portion of the tongue extends from the fixed end obliquely, with respect to the plane of the web, towards the free edges of the sidewalls. In accordance with a further embodiment, the free end of the tongue is proximate to the tab-receiving end of the receptacle portion. In accordance with a further embodiment, the fixed end of the tongue is proximate to the inner end of receptacle portion. In accordance with a further embodiment, the web has stop portions which are proximate to the side edges of a tongue and which extend beneath the tongue, and beyond the side edges of the opening in the web thereby to prevent overstressing of the tongue during flexure. In accordance with a further embodiment, the stop portions comprise ears which are produced by severing the web along severing lines that extend transversely from the associated edge of the opening in the web, the ears being subsequently coined so that they project beyond the side edges of the opening. In accordance with a further embodiment, an insulating housing is provided in surrounding relationship to the terminal and is axially movable relative to the terminal. The housing has a shoulder which engages the engaging portion of the tongue during relative movement to flex the tongue and disengage the tab from the receptacle portion.

DESCRIPTION OF THE DRAWINGS

FIG. 2 is a perspective view of a stamped blank from which terminals in accordance with the invention are produced by subsequent forming operations.

FIGS. 3 and 4 are views similar to FIG. 2 illustrating the forming operations to produce the finished terminal from the blank of FIG. 2.

Figure 6:
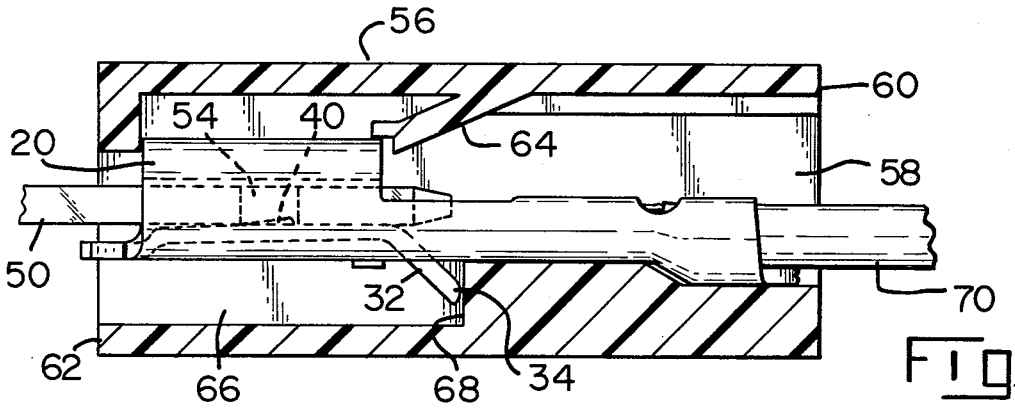
FIG. 6 is a cross-sectional view of a terminal receptacle in accordance with the invention contained in an insulating housing, this view showing the normal positions of the parts and showing a terminal tab mated with the terminal receptacle.

Terminals 2 in accordance with the invention are produced in continuous strip form with the individual terminals 2 connected by connecting sections 16 to a continuous carrier strip 4. Each terminal comprises a receptacle portion 6, a transition section 8, and a crimpable section 10. The crimpable section is comprised of a wire crimp portion 12 which is crimped onto the strands of a wire 70 and an insulating crimp portion 14 which is crimped onto the insulation of the wire as shown in FIG. 6.

The receptacle portion 6 has a terminal receiving end 15 which is dimensioned to receive a tab 50 (FIG. 6) and an inner end 17 which adjoins the transition section 8 of the terminal. The receptacle portion 6 comprises a web 18 from the marginal side portions of which sidewalls 20 extend. These sidewalls are curled as shown at 22 inwardly towards each other and towards the web so that the free edge portions 24 are spaced from the surface of the web.

Figure 5:
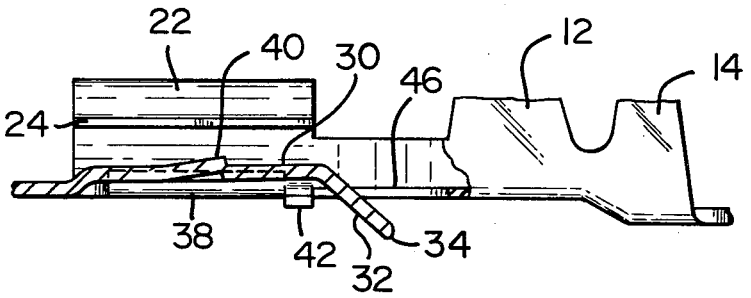
FIG. 5 is a view taken along the lines 5—5 of FIG. 1.

A latching tongue 26 is struck from the web 18 and has a fixed end 28 which is integral with the web at a location proximate to the tab receiving end 15. The tongue has an intermediate portion 30 and an engaging ear 32 which extends from the intermediate portion to the free end 34 of the tongue, see FIG. 6. The intermediate portion extends obliquely upwardly as viewed in FIG. 1 from the plane of the web 18 and towards the free edge portions 24 of the sidewalls. The engaging ear 32 extends from the intermediate portion 30 relatively sharply away from the intermediate portion, through the opening 36 in the web so that the free end 34 is below the plane of the web as viewed in FIG. 5 and the ear can be engaged to bring about flexure of the tongue. On its upper surface as viewed in FIG. 1, the intermediate portion 30 has an upward formed boss 40 which is dimensioned to receive in an opening 54 in the tab 50. Boss 40 is formed such that it has a sheer rightwardly facing shoulder as viewed in FIG. 5 thereby to prevent disengagement of the tongue from the tab.

In the embodiment shown, portions 38 of the web on each side of the side edges 35 of the tongue 30 are formed and displaced upwardly and are thereby located somewhat closer to the free edge portions 24 of the sidewalls. This feature has the effect of increasing the contact force in the electrical interface between the tab 50 and the receptacle portion of the terminal.

Figure 1:
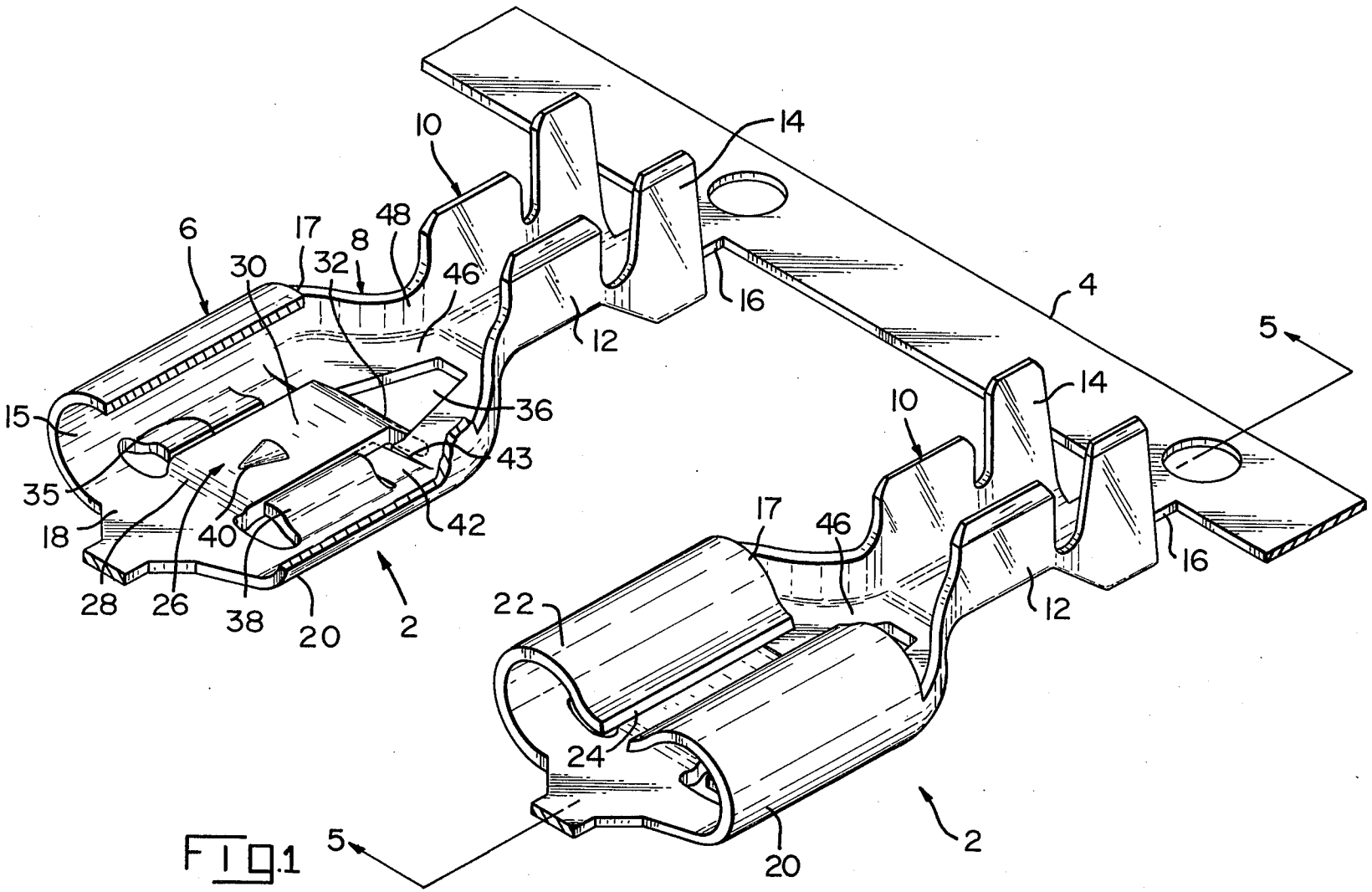
FIG. 1 is a perspective view, with parts brokwn away, of a short section of a strip of terminals in accordance with the invention.

It will be apparent from FIG. 1 that the web 18 extends beyond the receptacle portion 6 and partially into the transition section 8 as shown at 46 and the opening 36 also extends into this transition section.

Figure 7:
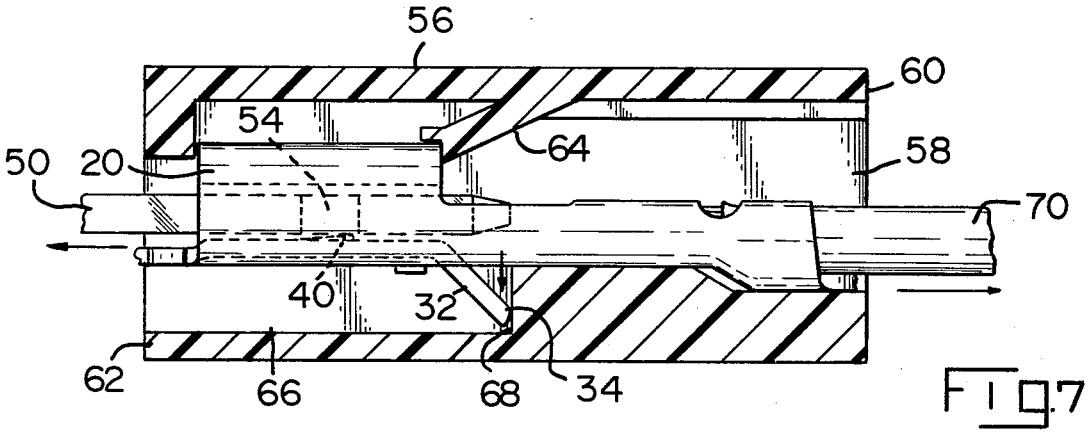
FIG. 7 is a view similar to FIG. 6, but illustrating the manner in which the terminal receptacle is disengaged from the terminal tab.

As will be explained below, the tongue is flexed downwardly as viewed in FIG. 6 when it is desired to disengage the tongue from the terminal tab 50. In order to prevent overstressing of the tongue and damage to the terminal, stop ears 42 are provided which extend from the web past the side edges 45 (FIG. 3) of the opening 36 and which project beneath the intermediate portion 30 of the tongue 26. These ears thus prevent downward movement of the tongue beyond the position shown in FIG. 7 and thereby prevent overstressing of the tongue. The stop ears 42 are produced by shearing the web along parallel shear lines 43, FIG. 3, that extend normally of the edges 45 of the opening and bending the thus formed ears, which are between the shear lines 43 relatively downwardly by a slight amount. The ears are then coined, that is compressed between tooling members in a manner such that they are elongated as a result of a reduction in the cross-sectional areas. During coining, the end portions of the tongue are moved inwardly and beyond the edges 45 thus providing the stops for the tongue.

The transition section 8 is of decreasing width from the inner end 17 of the receptacle portion and may have upstanding sides as shown at 45 for strengthening purposes. The transition section serves only to connect the wire crimp portion 14 to the rearward or inner end 17 of the receptacle portion, and the length of this transition section will vary depending upon the width of the receptacle portion of the terminal.

The method of producing terminals in accordance with the invention is illustrated in FIGS. 2, 3, and 4, the flat blank being shown in FIG. 2 and the preferred sequence of forming steps being illustrated in FIGS. 3 and 4. The reference numerals which are used to describe the blank are also applied to the blank and partially formed terminal in FIGS. 2–4 but are differentiated by prime marks. It is desirable to provide an additional carrier strip 47 during stamping and forming of the strip which is connected by a connecting section 49 to the right-hand section of the flat blank as viewed in FIG. 2. FIG. 3 illustrates the initial formation of the tongue and the shearing along the shear lines 43 of the stop ears 42. FIG. 4 illustrates the partial forming of the sidewalls 20, and the coining of the stop ears.

Terminals in accordance with the invention can be used as uninsulated terminals if desired. The terminal is simply crimped onto the end of a wire and when a tab is inserted into the receptacle portion, the boss 40 will enter the opening 54 in the tab 30 thereby positively latching the parts to each other. If it is desired to disengage the receptacle from the tab, the engaging portion 32 of the tongue is pushed to cause relative movement of the intermediate portion of the tongue towards the plane of the web 18 until the boss 40 moves out of the opening 54.

Under many circumstances, it is desirable to provide an insulating housing 56 in surrounding relationship to the terminal. The housing has an opening 58 extending therethrough from the rearward end 60 to the tab receiving end 62. A stop arm 64 is provided in the opening which engages the sidewalls of the terminal and prevents its removal from the opening. The stop arm 64 also serves to stabilize and locate the terminal in the forward portion 66 of the opening 58. Additional stops may be provided to prevent movement of the terminal leftwardly from the position shown in FIG. 6 through the housing.

Housing 56 is capable of limited axial movement relative to a terminal 2 contained therein and the opening 66 has an end wall or shoulder 68 which is proximate to the free end 34 of the tongue. When it is desired to disengage the tab 50 from the terminal in FIG. 6, the housing is moved relatively leftwardly from the position shown in FIG. 6 to the position shown in FIG. 7. This operation can be carried out by grasping the wire 70 and moving the housing 56 relative to the housing. During such movement, the shoulder 68 will move against the free end 34 of the tongue and bring the tongue downward so that the tab 50 can be withdrawn from the receptacle.

Figure 8:
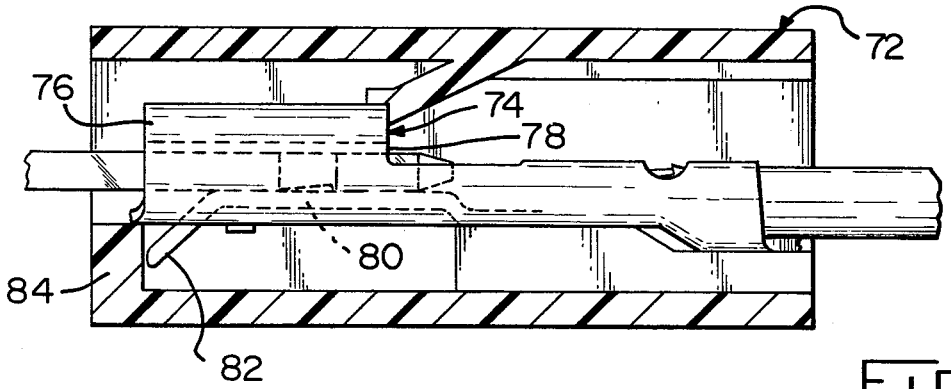
FIG. 8 is a view similar to FIG. 6 showing an alternative embodiment.

FIG. 8 shows an alternative embodiment comprising a housing 72 and a terminal 74 which is in most respects similar to the previously described terminal 2. The terminal receptacle has a tab receiving end 76 and an inner end 78. In the terminal 74, the fixed end of the tongue is proximate to the inner end 78 of the terminal and the free end 82 of the tongue is proximate to the tab receiving end 76 of the terminal. The housing 72 has a wall 84 at its tab receiving end which engages the free end 82 of the tongue and flexes the tongue downward when it is desired to disengage the tab from the terminal receptacle.

A salient advantage of the invention is that the tongue 30 is formed entirely from material contained in the web 18 and terminals in accordance with the invention can therefore be produced with a minimum amount of stock metal for each terminal. This feature is of significance in terminals of the type under consideration for the reason that the cost of the metal stock represents a high percentage of the initial cost of producing the terminal.

By virtue of the fact that the portions 38 of the web are formed inwardly and towards the free edge portions 24 of the sidewalls, a wide range of contact forces can be developed at the electrical interface and the provision of the latching feature in the receptacle terminal does not therefore necessitate a corresponding reduction in the level of the contact force.

I claim:

1. A stamped and formed receptacle terminal of the type having a receptacle portion which is dimensioned to receive a tab type terminal, the receptacle portion having a web and having sidewalls extending from the marginal side portions of the web, the sidewalls having portions which extend inwardly over the web and towards each other and having free edges which are spaced from the surface of the web, the receptacle portion having a tab receiving end and an inner end whereby upon relative movement of the tab into the tab receiving end towards the inner end, electrical contact is established between the tab and the receptacle portion, the receptacle portion having a releasable latch for releasably latching the tab to the receptacle portion, the receptacle portion being characterized in that:

the releasable latch comprises a latching tongue struck from the web of the receptacle portion, the web having an opening therein which was produced when the tongue was struck from the web, the tongue having a fixed end, a free end, and said edges extending between the ends and alongside the marginal side portions of the web, the fixed end being proximate to one of the ends of the receptacle portion and the free end being proximate to the other end of the receptacle portion, the tongue having an intermediate portion which extends from the fixed end obliquely with respect to the plane of the web towards the free edges of the sidewalls, an engaging ear extending from the intermediate portion to the free end, the engaging ear extending away from the free edges of the sidewalls and through the opening in the web whereby the free end of the tongue can be engaged, the web having stop portions which are proximate to the side edges of the tongue intermediate the ends of the tongue, the stop portions extending beneath the tongue and into the opening in the web, the tongue extending between the stop portions and the free edges of the sidewalls thereby to prevent overstressing of the tongue during flexure thereof, and latching portions on the tongue which are engageable with complementary latching portions on the tab when the tab is inserted into the receptacle portion thereby to latch the tab to the receptacle portion whereby, the tongue can be disengaged from the tab by engaging the engaging portion of the tongue and flexing the tongue away from the free edges of the sidewalls until the latching portions of the tongue are disengaged from the complementary latching portions of the tab.

2. A stamped and formed receptacle terminal as set forth in claim 1 characterized in that the fixed end of the tongue is proximate to the tab-receiving end of the receptacle portion.

3. A stamped and formed receptacle terminal as set forth in claim 1 characterized in that the fixed end of the tongue is proximate to the inner end of the receptacle portion.

4. A stamped and formed receptacle terminal as set forth in claim 1 characterized in that the stop portions comprise ears, each ear being severed from the web along severing lines that extend transversely from the associated edge of the opening in the web, the ears being coined so that they project beyond the edges of the opening in the web.

5. A stamped and formed receptacle terminal as set forth in claim 4 characterized in that the latching portions on the tongue comprise a boss formed on the tongue, the complementary latching portions on the tab being an opening in the tab.

6. A stamped and formed receptacle terminal as set forth in claim 1 characterized in that an insulating housing is provided in surrounding relationship to the terminal, the housing having a cavity extending therethrough in which the terminal is disposed, the housing being relatively axially movable with respect to the terminal and having a tongue engaging shoulder which engages the engaging ear and flexes the tongue upon relative movement of the housing with respect to the terminal thereby to disengage the tab from the terminal.

7. A stamped and formed receptacle terminal as set forth in claim, 1 characterized in that the stop portions are portions of the web on each side of the tongue which are displaced upwardly from the plane of the web and towards the free edges of the sidewalls.

* * * * *